United States Patent [19]

Weis

[11] 4,189,106

[45] Feb. 19, 1980

[54] DELIVERY ARM FOR A LAYING REEL OF A WIRE OR ROD MILL

[75] Inventor: Herbert Weis, Essen, Fed. Rep. of Germany

[73] Assignee: Fried. Krupp Gesellschaft mit beschränkter Haftung, Essen, Fed. Rep. of Germany

[21] Appl. No.: 24,074

[22] Filed: Mar. 26, 1979

[30] Foreign Application Priority Data

Apr. 1, 1978 [DE] Fed. Rep. of Germany ..... 2814143

[51] Int. Cl.[2] ..... B21C 47/00

[52] U.S. Cl. ..... 242/82

[58] Field of Search ..... 242/82, 83, 47.01, 47, 242/47.12; 19/159; 29/81; 72/135, 142, 143, 144

[56] References Cited

U.S. PATENT DOCUMENTS

| | | | |
|---|---|---|---|
| 2,742,737 | 4/1956 | McElroy | 242/82 X |
| 2,997,249 | 8/1961 | Meinshausen | 242/82 |
| 3,128,961 | 4/1964 | Wickwire | 242/82 |
| 3,563,488 | 2/1971 | Bollig | 242/82 |

*Primary Examiner*—Edward J. McCarthy
*Attorney, Agent, or Firm*—Karl F. Ross

[57] ABSTRACT

A delivery arm for depositing wire in a laying reel has an elongated and rigid support member formed generally as a three-dimensional spiral having an upper axially opening inlet end and a lower tangentially opening outlet end. Two generally parallel rows of rollers are mounted on the support member and define a generally spiral path therealong for a rod or wire that moves from the inlet end to the outlet end. Each of the rollers is rotatable about a respective roller axis generally perpendicular to the path at the respective roller and has a generally hyperboloidal outer surface engaging and guiding the wire or rod.

10 Claims, 2 Drawing Figures

DELIVERY ARM FOR A LAYING REEL OF A WIRE OR ROD MILL

FIELD OF THE INVENTION

The present invention relates to a delivery arm for depositing wire or rod in a laying reel. More particularly this invention concerns such an arm used at the downstream end of a wire- or rod-mill line for forming the wire or rod into coils suitable for handling either for further treatment or for shipping.

BACKGROUND OF THE INVENTION

It is standard practice to form wire or rod into coils so that it can be handled conveniently. This coiling is normally done at the downstream end of a rolling or drawing line of a wire or rod mill. To this end the wire, which is delivered in a straight horizontal line, is normally bent gently through 90° so that it moves continuously downward along a vertical axis toward the location where it is to be formed into a coil.

A delivery pipe is provided which is generally spiral shaped and which has an upper inlet end opening along this vertical axis and receiving the wire and a lower outlet end which opens generally tangentially of a circle lying in a plane perpendicular to the vertical axis. This entire pipe is rotated about the vertical axis so its outlet end moves at a peripheral speed equal to the speed at which the wire is delivered. Thus the arrangement is capable of forming a stack of coils constituting a very neat bundle.

It has been suggested in German application 2,039,572 published 17 Feb. 1972 to reduce wear of this pipe by providing it with a succession of so-called roller stars alternating with annular guide collars. Each roller star has three rollers each lying in a respective plane including the respective portion of the guide path along which the wire or rod passes in the pipe, the planes being angularly equispaced at 120°. All of the rotation axes of the rollers of each star lie in a respective plane perpendicular to the path at the respective location.

This arrangement does indeed considerably reduce wear, but is quite complex and, hence, rather expensive. It is usually necessary to completely disassemble the delivery arm if a single roller or its bearing wears out. Furthermore the guide collars provided between the stars are subject to considerable wear.

OBJECTS OF THE INVENTION

It is therefore an object of the present invention to provide improved wire or rod coiling apparatus and laying arms therefor.

Another object is the provision of such an arm which is relatively simple in construction and, hence, inexpensive to manufacture, yet of long service life.

Yet another object is to provide an improved arm which is easier to service than the hitherto-known arms.

SUMMARY OF THE INVENTION

These objects are attained according to the invention in a laying or delivery arm comprising a rigid support member formed by a bar or tube and shaped generally as a spiral having an inlet end and an outlet end. Two generally parallel rows of rollers are mounted on this support member and define a generally spiral path for the rod or wire extending between the inlet and outlet ends. The rollers are arranged in pairs flanking the path with the rollers of each pair generally coplanar, that is rotatable about parallel axes flanking the path. Each roller has a generally hyperboloidal outer surface engageable with the rod or wire and forming with the other roller of the pair a generally laterally closed passage for the rod or wire.

With the system according to the invention the rollers are externally mounted on the support member, not internally mounted, so that they can be inspected and serviced with ease. According to another feature of the instant invention of the rollers are mounted removably on respective axles on support plates each carrying a respective roller pair. Thus if any one roller is damaged, it is possible easily to remove and replace it, right in the laying reel, so that a considerable saving in maintenance costs is realized.

SPECIFIC DESCRIPTION

Figure 1:
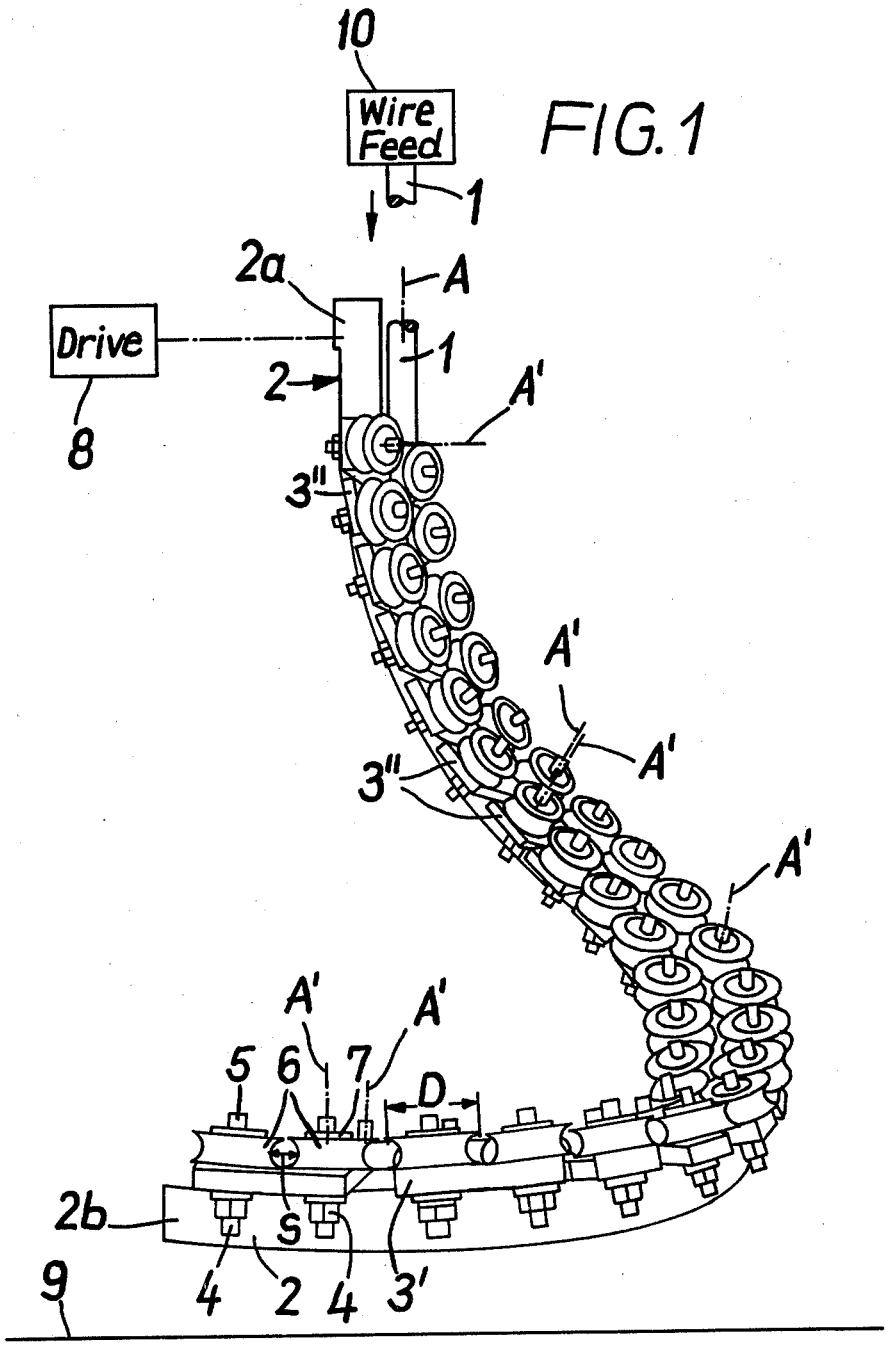
FIG. 1 is a side view of a cable or wire coiler with a laying arm according to this invention.

A laying arm according to this invention has a support member 2 formed as a bar or tube and extending along a generally spiral path between an upper inlet end 2*a* and a lower outlet end 2*b*. A drive 8 rotates this member 2 about an upright axis A. A pair of rollers 6 each of hyperboloidal shape and centered on respective axes A′ are mounted via mounting plates 3′ and 3″ on the member 2 and define a path opening at its upper end at the axis A and at its lower end generally tangential of an imaginary circle or orbit centered on the axis A and lying in a plane perpendicular thereto. Each of the rollers 6 is mounted on a respective axis 5 and is secured thereto by means of a washer 7. Nuts 4 secure these axles 5 to the plates 3′ and 3″, the latter each carrying only two rollers, one from each row, and the former carrying four rollers apiece, two from one row and two from the other row.

Figure 2:
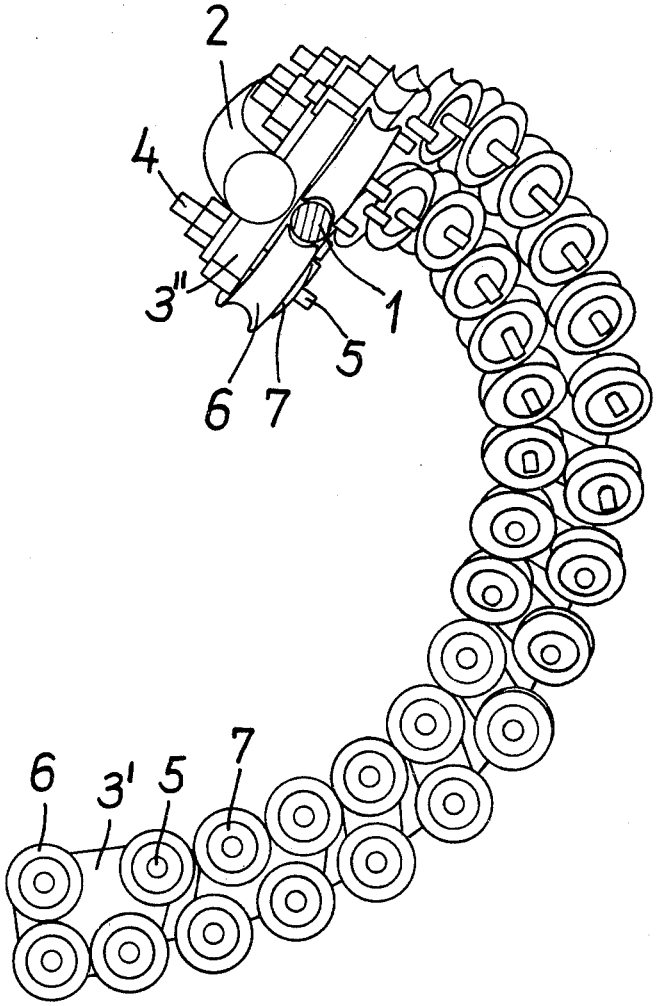
FIG. 2 is a top view of the laying arm of FIG. 1.

The rollers 6 have diameters D equal to at least four times the spacings s between adjacent rollers. These rollers 6 as best seen in FIG. 2. form a laterally closed passage adapted to guide a wire or rod 1 fed in from a wire feed 10.

In operation the drive 8 rotates the entire arm about the axis A at a speed such that the output end 2*b* moves at a peripheral speed equal to the speed at which wire is fed in by the feed 10. Thus the wire will be formed into a coil and deposited on a support surface 9. In the event that any of the rollers 6 is damaged, it is a very simple taks to remove it from the respective axis 5 and replace it.

I claim:

1. A delivery arm for depositing wire or rod in a laying reel, said arm comprising:

an elongated and rigid support member formed generally as a three-dimensional spiral having an inlet end and an outlet end; and two generally parallel rows of rollers mounted on said support member and defining a generally spiral path along said support member for said wire or rod, each of said rollers being rotatable about a respective roller axis generally perpendicular to said path at the respective roller and having a generally hyperboloidal outer surface engageable with said wire or rod.

2. The arm defined in claim 1 wherein the rollers of one of said rows are staggered relative to the rollers of the other row, said rollers being arranged in pairs flanking said path with the rollers of each pair substantially coplanar.

3. The arm defined in claim 1, further comprising a plurality of mounting plates each carrying a respective roller of one of said rows and a respective roller of the other row.

4. The arm defined in claim 1 wherein said support member is a rod.

5. The arm defined in claim 1 wherein said support member is a tube.

6. The arm defined in claim 1, further comprising a plurality of axles fixed to said support member, each lying on a respective roller axis, and each carrying a respective roller.

7. The arm defined in claim 6, further comprising means for releasably securing each of said rollers to the respective axle.

8. The arm defined in claim 1 wherein said rows have substantially the same number of rollers.

9. The arm defined in claim 1 wherein each of said rollers is spaced from each of the adjacent rollers of the same row by a distance equal to at most one-quarter of the roller diameter.

10. A laying reel comprising:

a delivery arm having an elongated and rigid support member formed generally as a three-dimensional spiral centered on an upright member axis and having an upper inlet end opening generally axially on said axis and a lower outlet end opening in a direction generally perpendicular to said axis at a location offset from said axis;

means for rotating said arm about said axis;

a body underneath said arm forming a generally planar receiving surface underneath said output end; and two generally parallel rows of rollers mounted on said support member and defining a generally spiral path along said support member between said ends thereof for rod or wire, each of said rollers being rotatable about a respective roller axis generally perpendicular to said path at the respective roller and having a generally hyperboloidal outer surface engageable with said wire or rod.

* * * * *